US012402703B2

(12) United States Patent
Dubois et al.

(10) Patent No.: US 12,402,703 B2
(45) Date of Patent: Sep. 2, 2025

(54) HAIR CLIP HAVING A HIDDEN HINGE

(71) Applicant: Each Jewels LLC, New York, NY (US)

(72) Inventors: Abigail L. Dubois, Danbury, CT (US); Lawrence H. Dubois, Danbury, CT (US)

(73) Assignee: Each Jewels LLC, New York, NY (US)

( * ) Notice: Subject to any disclaimer, the term of this patent is extended or adjusted under 35 U.S.C. 154(b) by 0 days.

(21) Appl. No.: 18/623,551

(22) Filed: Apr. 1, 2024

(65) Prior Publication Data

US 2025/0049192 A1 Feb. 13, 2025

Related U.S. Application Data

(63) Continuation-in-part of application No. 18/594,927, filed on Mar. 4, 2024, now Pat. No. 12,078,001, which is a continuation-in-part of application No. 18/375,962, filed on Oct. 2, 2023, which is a continuation-in-part of application No. 18/231,744, filed on Aug. 8, 2023, now Pat. No. 12,004,633.

(51) Int. Cl.
*A45D 8/20* (2006.01)

(52) U.S. Cl.
CPC ..... *A45D 8/20* (2013.01)

(58) Field of Classification Search
CPC ..... A45D 8/20; A45D 2/122; Y10T 24/3443; Y10T 24/3437; Y10T 24/3436; Y10T 24/3435; Y10T 24/3433; Y10T 24/1983; Y10T 24/1934; Y10T 24/19; Y10T 24/1644
See application file for complete search history.

(56) References Cited

U.S. PATENT DOCUMENTS 884,680 A * 4/1908 Polakoskey ..... A41B 3/08 211/119.13
2,459,926 A * 1/1949 Benedetto ..... A45D 8/20 132/277
2,540,042 A * 1/1951 Craigen ..... A45D 8/20 132/277
3,092,870 A 6/1963 Baer
(Continued)

FOREIGN PATENT DOCUMENTS

KR 200306880 * 3/2003

*Primary Examiner* — Nicholas D Lucchesi
*Assistant Examiner* — Jennifer Gill
(74) *Attorney, Agent, or Firm* — Brian Beverly; Beeson Skinner Beverly, LLP

(57) ABSTRACT

A hair clip having a hidden hinge includes two clip members each having a handle, an array of teeth for retaining hair, an engagement shoulder disposed between the handle and the array of teeth, and a resilient member disposed along the inner edges of the engagement shoulders and between the arrays of teeth of each clip member interconnecting and biasing the clip members toward a closed configuration, the engagement shoulders disposed in abutting engagement thereby forming an engagement seam, and the engagement shoulders disposed between the handles and the resilient member of the two clip members such that the resilient member is hidden behind the engagement seam when viewing the hair clip from an outer vantage point.

19 Claims, 14 Drawing Sheets

(56) References Cited

U.S. PATENT DOCUMENTS

| | | | | | |
|---|---|---|---|---|---|
| 3,341,242 | A * | 9/1967 | Carson | A47G 23/0208 | D7/706 |
| 3,369,585 | A * | 2/1968 | Martinsen | A45C 11/182 | 150/147 |
| D210,860 | S * | 4/1968 | Franciscus | D28/40 | |
| 5,337,451 | A | 8/1994 | Goossens | | |
| 5,787,905 | A * | 8/1998 | Yasuda | A45D 8/20 | 132/277 |
| 5,842,482 | A | 12/1998 | Potut | | |
| 5,873,377 | A * | 2/1999 | Yang | A45D 8/20 | 132/273 |
| 6,490,768 | B1 * | 12/2002 | Goodall | A47C 21/022 | 24/339 |
| 2003/0094555 | A1 * | 5/2003 | Prizzi | G09F 7/18 | 248/214 |
| 2009/0272397 | A1 | 11/2009 | Defenbaugh et al. | | |
| 2009/0277469 | A1 * | 11/2009 | Hsu | A45D 8/20 | 132/277 |
| 2010/0242987 | A1 * | 9/2010 | Washington | A45D 8/20 | 132/277 |
| 2021/0022469 | A1 * | 1/2021 | Freeman | A45D 8/20 | |

* cited by examiner

HAIR CLIP HAVING A HIDDEN HINGE

CROSS-REFERENCE TO RELATED APPLICATIONS

This application is a continuation-in-part of application Ser. No. 18/594,927, filed Mar. 4, 2024, which is a continuation-in-part of application Ser. No. 18/375,962, filed Oct. 2, 2023, which is a continuation-in-part of application Ser. No. 18/231,744, filed Aug. 8, 2023.

BACKGROUND

Technical Field

This invention relates to hair clips and more particularly to hair clips having a hinge mechanism positioned around and hidden behind inwardly extending engagement shoulders of the handles of the hair clip which form an engagement seam around which the clip members pivot.

Description of Related Art

Prior to the invention disclosed herein, a typical hair clip comprises two or more clip members coupled together by an outwardly visible spring-biased hinge. This hinge can have a central pivotal axis, such as in a traditional claw clip, or a side pivotal axis, such as in a side claw clip, alligator clip, or salon clip or spring steel snap clip. Retaining structures, aka, knuckles, and springs are generally visible, creating an undesirable appearance, as well as opportunities to break, tangle, or damage hair.

SUMMARY OF THE INVENTION

The invention discloses a hair clip with a resilient hinge mechanism such as a spring. The spring mechanism is disposed on the interior side of and engagement seam formed by two inwardly extending engagement shoulders thus presenting from an outer vantage point a single engagement seam.

As in a traditional hair clip, the clip members include one or more levers or handles used to widen the space between the teeth or combs. Placing the hinge mechanism between the teeth in the interior of the hair clip allows for a wider opening than with a traditional hair clip. When the handles are released, the hair is securely held between the teeth.

There are also aesthetic benefits to the invention: the hinge mechanism faces inwards towards the retained hair. Thus, hinge knuckles, hinge pins, and/or springs are partially or completely covered and not outwardly visible. An optional spring cover can be employed to prevent hair contact with the spring mechanism, but it is not a requirement.

DETAILED DESCRIPTION OF THE ILLUSTRATED EMBODIMENT

Figure 1A:
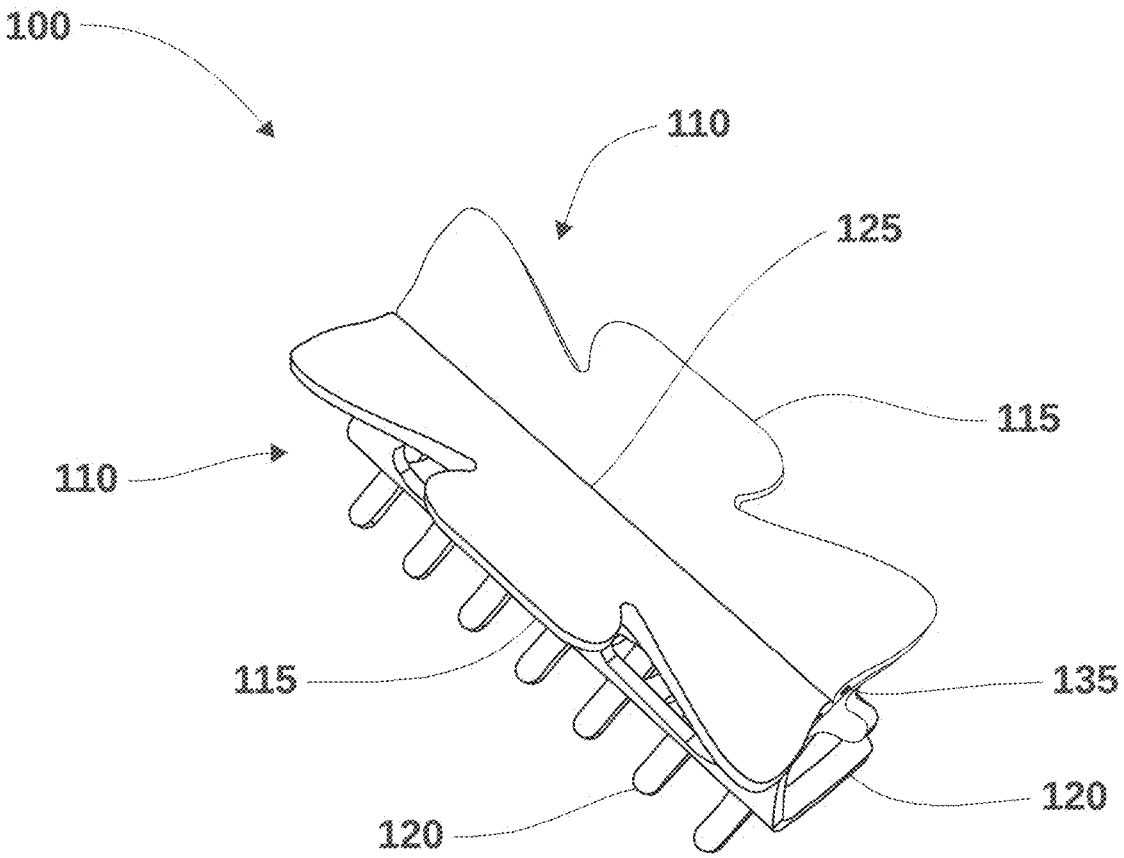
FIG. 1A is an upper perspective view of a first embodiment of a hair clip having a hidden hinge shown in a closed configuration.
Figure 1B:
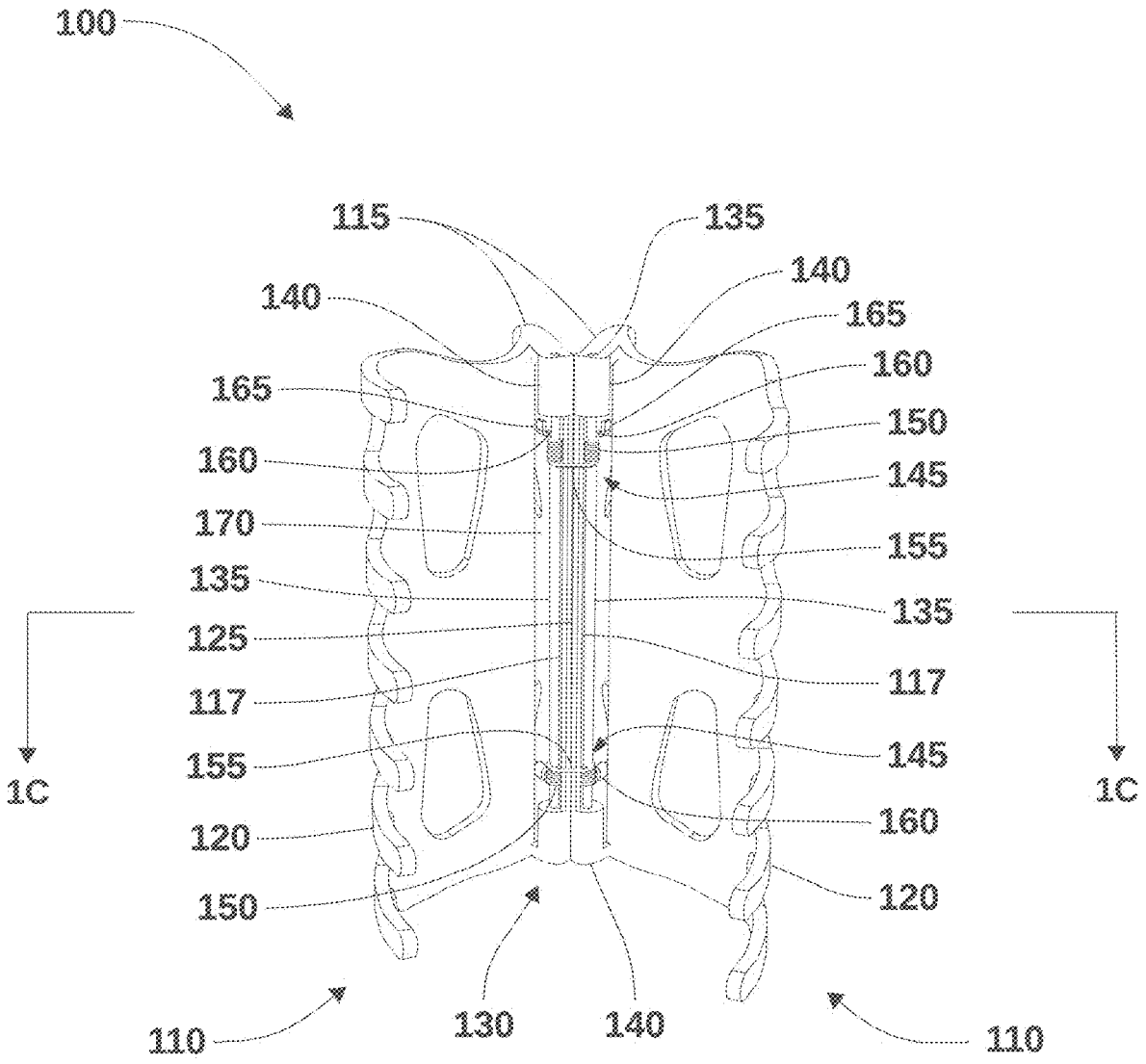
FIG. 1B is a bottom perspective view thereof showing the hair clip in a partially open configuration.
Figure 1C:
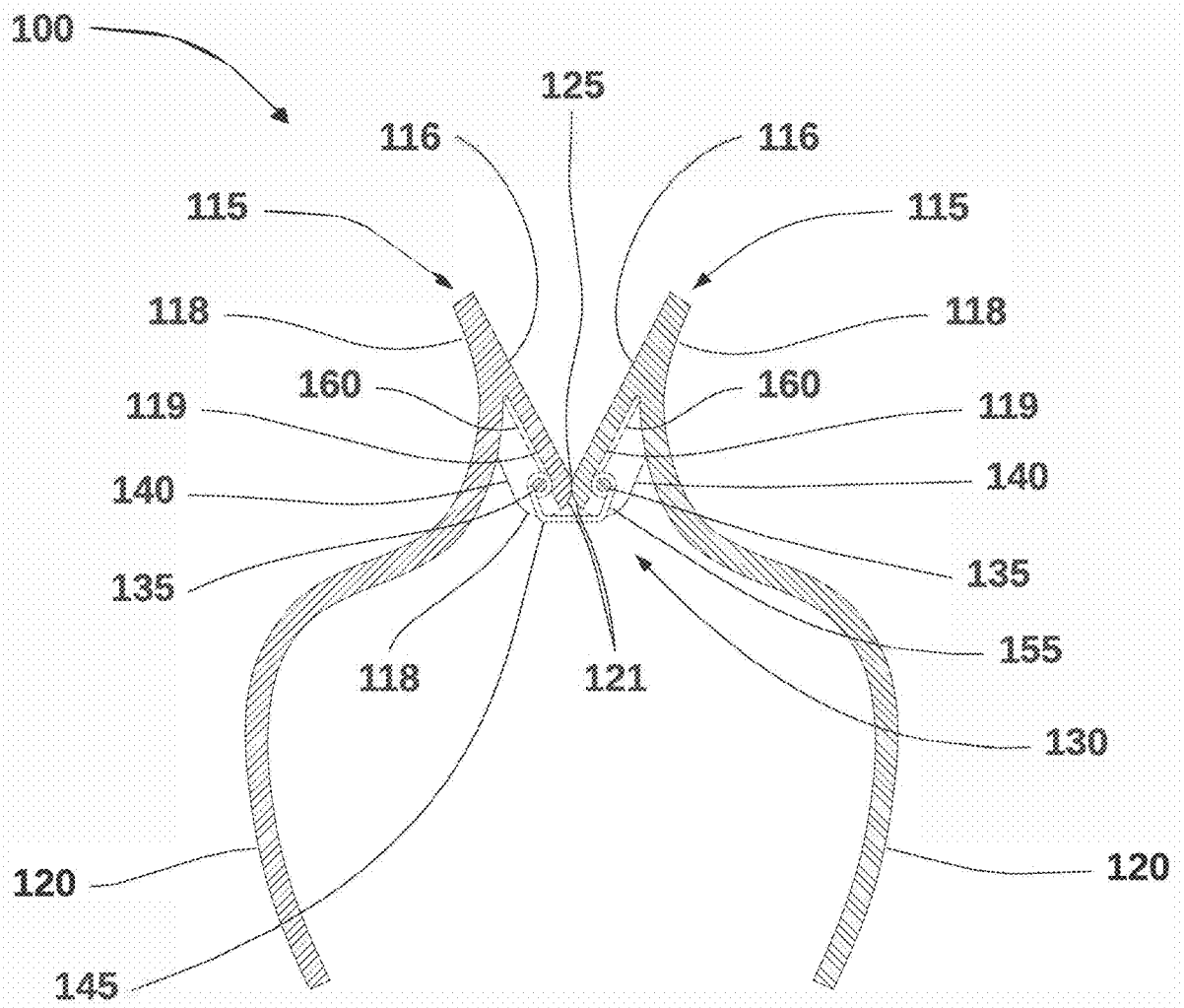
FIG. 1C is a sectional view thereof taken along lines 1C-1C of FIG. 1B.
Figure 1D:
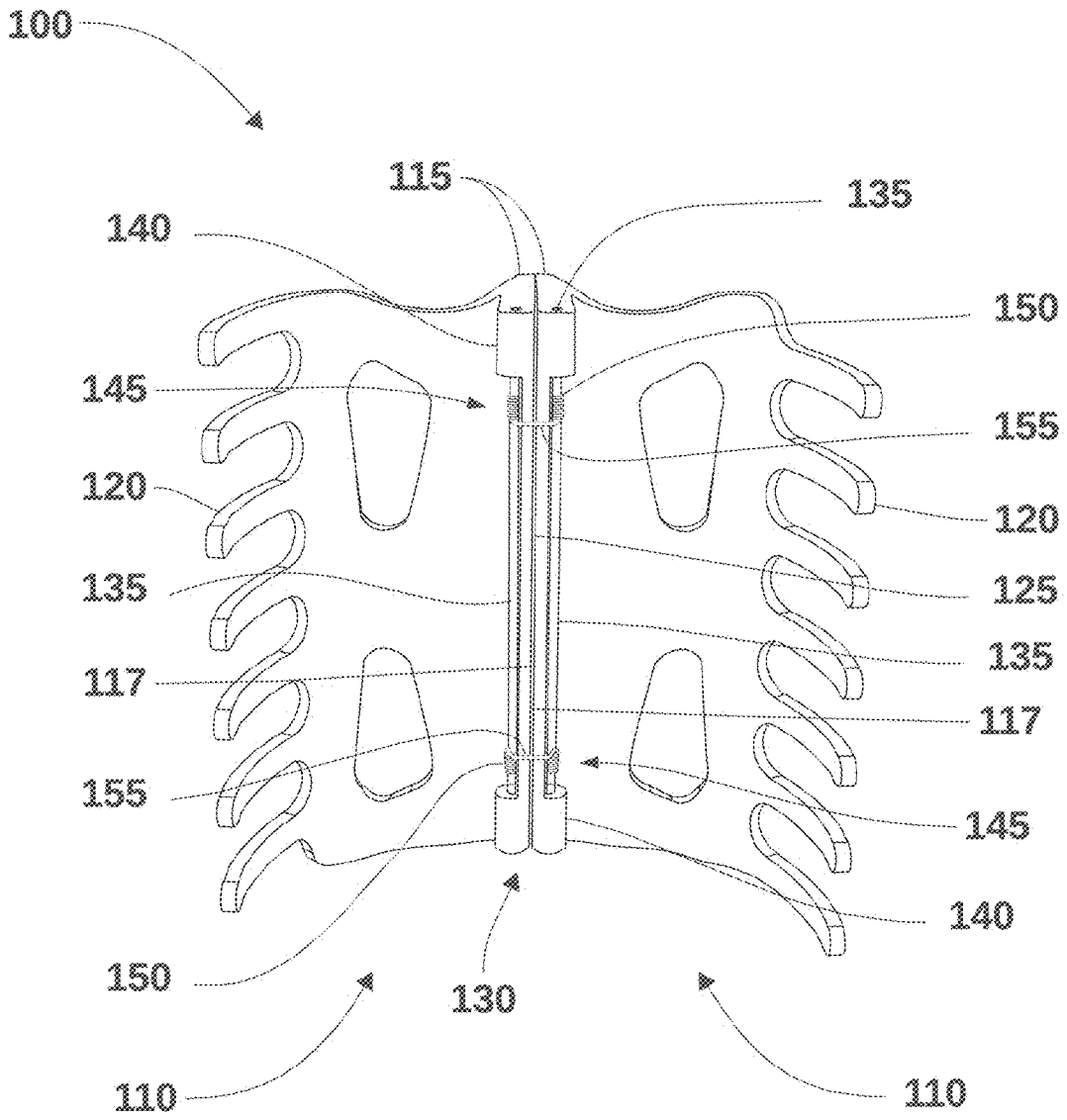
FIG. 1D is a bottom perspective view thereof showing the hair clip in a fully open configuration.
Figure 1E:
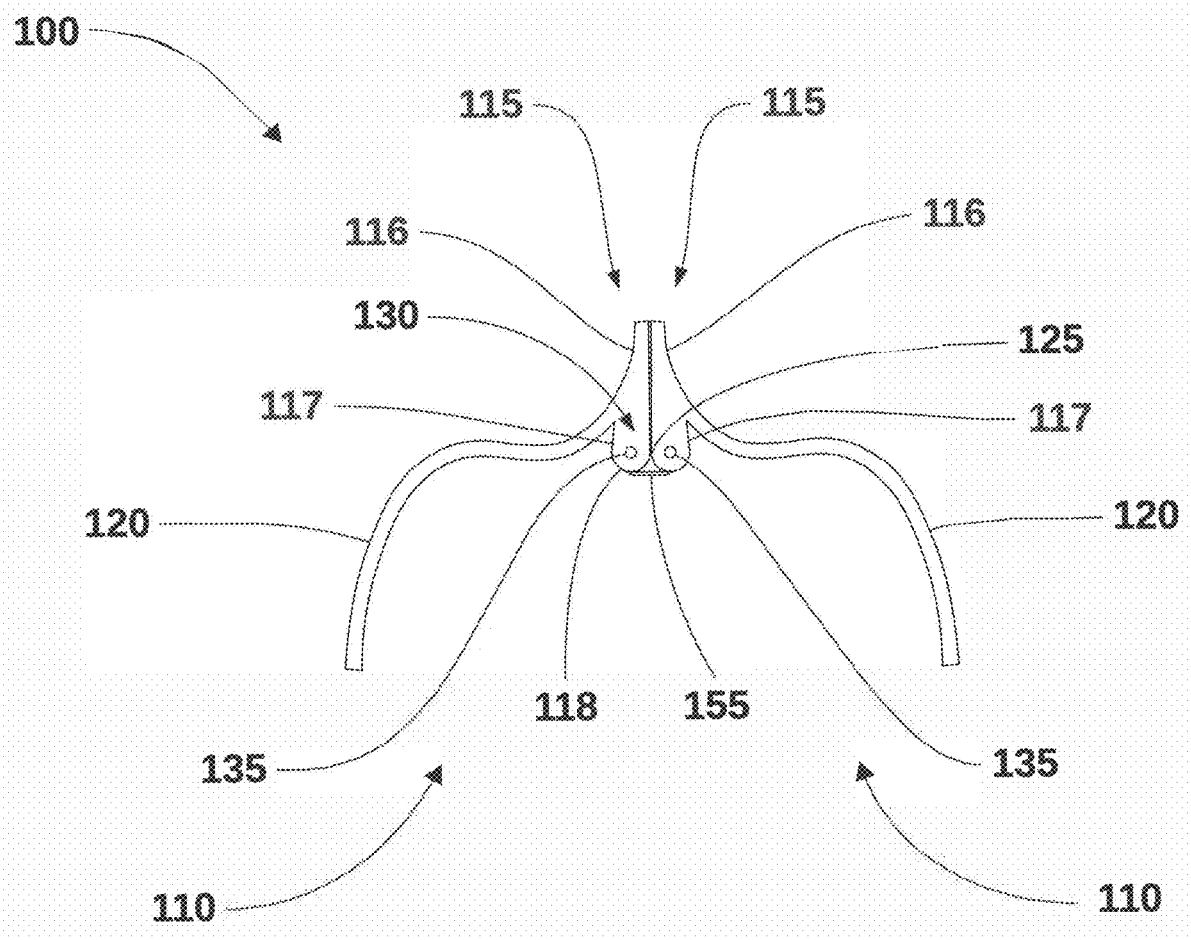
FIG. 1E is a side elevational view thereof showing the hair clip in a fully open configuration.

A first embodiment of hair clip having a hidden hinge, indicated at 100 in FIGS. 1A-1E, comprises two adjacent clip members 110 each including a grabbable handle 115 and an array of teeth 120. Each handle 115 includes an abutment face 116 which faces the abutment face 116 of the other handle 115, and an obverse face 117 on the opposite side of the handle 115. Arrays of teeth 120 extend from the obverse faces 117 of the handles 115 between the outer portions 118 and the inner portions 119 thereof as shown. Inwardly facing engagement shoulders 121 (see FIGS. 1B-1E) on the inner ends of the handles 115 are in abutting disposition and form between them an engagement seam 125 extending along the arrays of teeth 120 of the clip members 110. While the engagement seam 125 in the illustrated embodiment is shown extending continuously along the full lengths of the handles 115 and teeth 120, in other embodiments gaps can be provided in or along the engagement seam so that it is separated into two or more engagement seams.

The clip members 110 are coupled and held together by a spring 145 or other resilient material that extends across and is adjacent to the inner edges 122 of engagement shoulders 121. In this application the word "inner" and variants thereof refer generally to the area bounded by the arrays of teeth 120 and the engagement shoulders 121 of the clip members 110. Thus, as can be seen from FIGS. 1B-1E, the abutting engagement shoulders 121 form a functional hinge 130 about which the clip members 110 pivot, the handles 115 acting as levers that open the teeth 120. And, when viewing the hair clip from an outer or handle-side vantage point, such as shown in FIG. 1A, the spring 145 is hidden.

With continuing reference to FIGS. 1B-1E, pivot pins 135 disposed in retaining structures 140 create axes around which handles 115 and teeth 120 pivot. The clip members 110 are coupled together by dual axis torsion springs 145 which return the claw clip to its closed position in which the teeth 120 are positioned to retain hair. Each torsion spring 145 has two coiled portions 150 interconnected by connector 155. Connectors 155 that comprise resilient or non-resilient materials are understood to be within the scope of this invention. One of the pivot pins 135 is rotatably received in the center bore formed by each coiled portion 150 such that the coiled portions 150 of each spring 145 wind around and extend along the axes formed by pivot pins 135 and are spaced apart perpendicularly to the axial extent thereof. Each coiled portion 150 is disposed on the inner portion 119 of the obverse face 117 of one of the handles 115 and is thus affixed to the teeth 120 of one of the clip members 110, so that the coiled portions 150 are wound more tightly as the clip members pivot from the closed configuration, seen in FIG. 1A, to an open configuration, such as seen in FIGS. 1B-1E.

In the illustrated embodiment, a short extension 160 of spring 145 is affixed behind catch 165 to the inner portion 119 of the obverse face 117 of each handle 115 and biases the clip members 110 toward the closed configuration. It will be understood, however, that the coiled portions 150 of the springs 145 may be attached directly to the teeth 120 of the clip members 110 in various ways that bias the clip members 110 toward a closed configuration.

It will be understood that, while the retaining structures 140 and pivot pins provide pivot axes and anchor points for the dual axis torsion springs 145, only the engagement shoulders 121 and one or more resilient structures such as springs are needed to create a functional hinge. In other embodiments hinge types may include, but are not limited to, two-pin hinges, hinges with virtual pivot axes, single pin hinges, single pin hinges in combination with a virtual pivot axis and living hinges. Such hinges are biased toward the closed position using resilient or elastomeric materials or components or springs. While the embodiments described in this application focus on springs, other resilient materials or devices that have an elastic body that recovers its original shape when released after being distorted fall within the ambit of this invention.

Positioning the engagement shoulders 121 between the handles 115 and the spring 145 of each clip member 110 hides all or part of the spring 145 behind the handles 115, the engagement shoulders 121, and the engagement seam 125 when the hair clip is viewed from an outer, or handle-side, vantage point as seen in FIG. 1A. This provides a unique aesthetic advantage over prior art hinged hair claw clips and is particularly advantageous when the teeth 120 of the hair clip are in use retaining hair because only the handles 115 and the engagement seam 125 between the handles generally will then be visible.

Figure 1F:
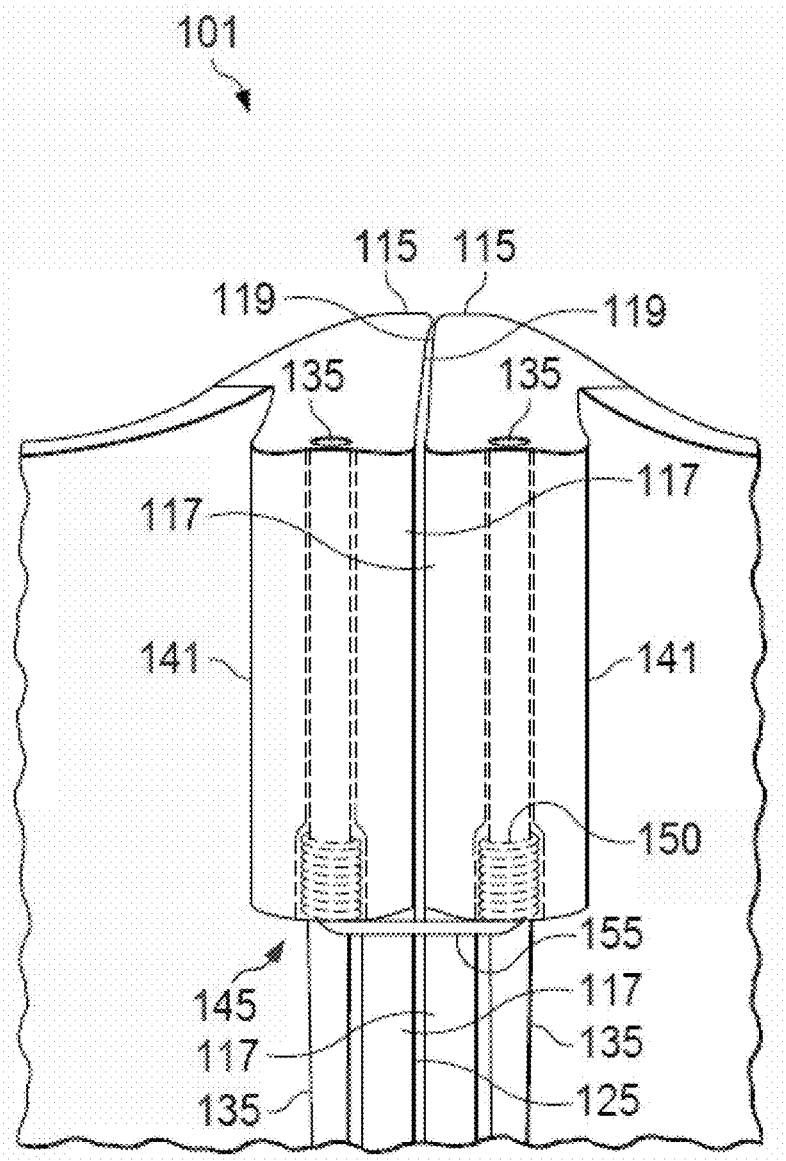
FIG. 1F is an enlarged portion of a portion of another embodiment of the invention similar to that shown in FIGS. 1A-1E.

In other embodiments of the device a separate cover may be provided between the teeth of the clip members that cover and hide the spring mechanism from an inner vantage point. Thus, with reference to FIG. 1F, in an enlarged view of a portion of another embodiment 101 of a hair clip according to the invention, similar to the embodiment shown in FIG. 1E, the coiled portions 150 and a length of the pivot pins 135 (both indicated in broken lines) of the spring 145 are enclosed in retaining structures 141. Each of the retaining structures 141 includes an abutment face 116 which engages the abutment face 116 of another of the retaining structures in the open position as shown.

Figure 2A:
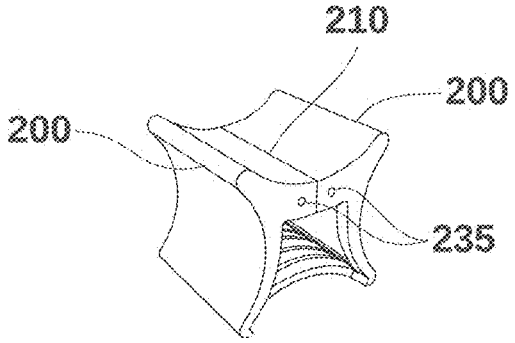
FIGS. 2A-2D show representative examples of how the first embodiment of the invention disclosed herein may be applied to four different hair claw clip styles.

FIGS. 2A-2D show additional examples of how the invention may be applied to four representative styles of hair claw clips having four different types of hinges. FIG. 2A shows an ornamental hair claw clip with two clip members 200 and a single seamed hinge 210, wherein the clip members 200 pivot about the pins 235 in the claw clip. Springs on the underside of the claw, which ensure closure, are not illustrated.

Figure 2B:
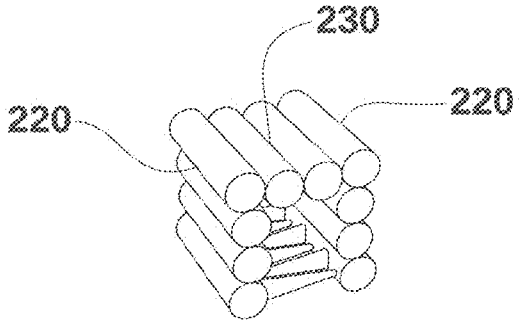

FIG. 2B shows an extruded ornamental hair claw clip having two clip members 220 and a single seamed hinge 230, wherein the clip members 220 pivot about a hidden hinge on the underside of claw clip. The resilient material provided on the underside of the claw to ensure closure is not shown for clarity.

Figure 2C:
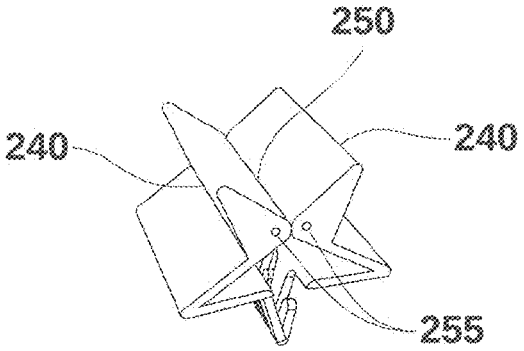

FIG. 2C is a perspective view of an extruded star ornamental hair claw clip having two clip members 240 and a single seamed hinge 250, wherein the clip members 240 pivot about pivot pins 255 in the claw clip. An elastomer provided on the underside of the claw clip to ensure closure is not shown for clarity.

Figure 2D:
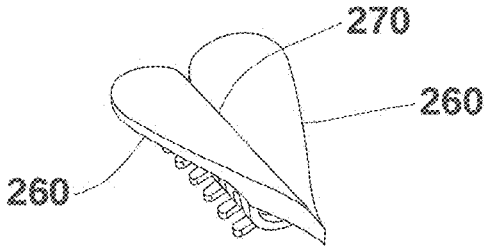

FIG. 2D is a perspective view of a heart shaped ornamental hair claw clip with two clip members 260 and a single seamed hinge 270, wherein the clip members 260 pivot about a hidden hinge in the claw clip. Springs provided on the underside of the claw to ensure closure are not shown for clarity. It is understood that one or more body members may be made from resilient material to open and close the clip members to readily retain hair.

Figure 3A:
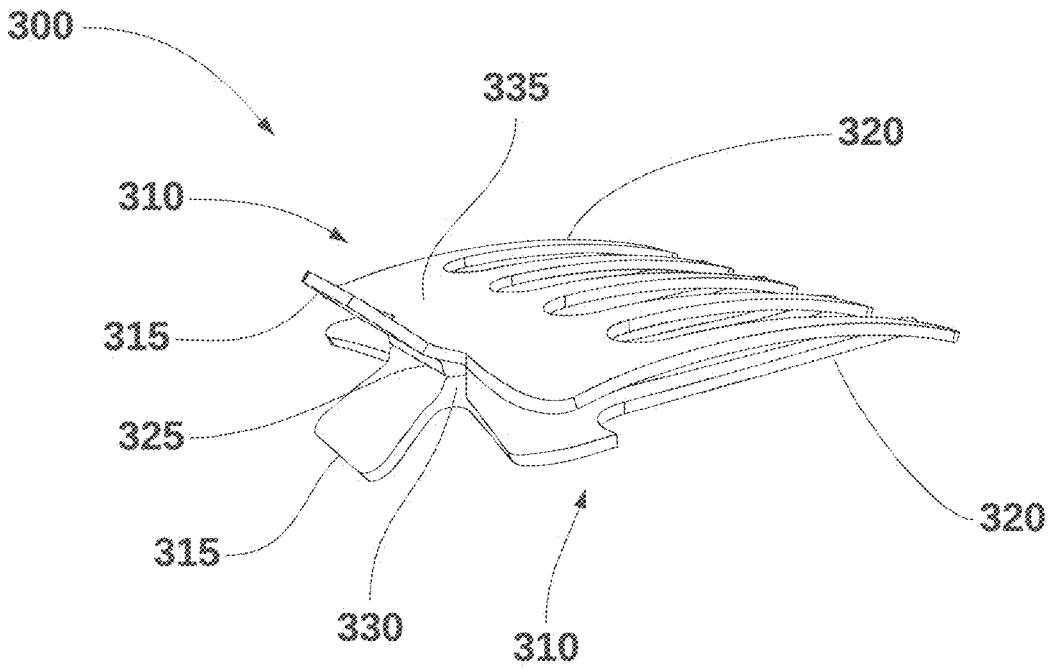
FIG. 3A is an upper right rear perspective view of a second embodiment thereof showing the hair clip in a closed configuration.
Figure 3B:
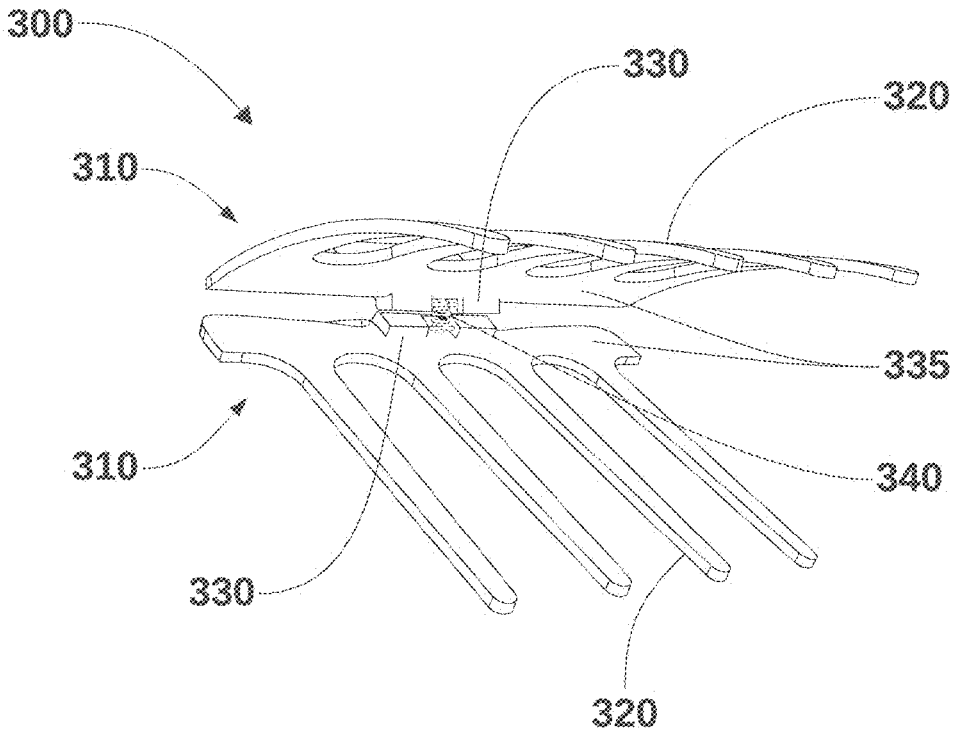
FIG. 3B is an upper right front perspective view thereof showing the hair clip in an open configuration.
Figure 3C:
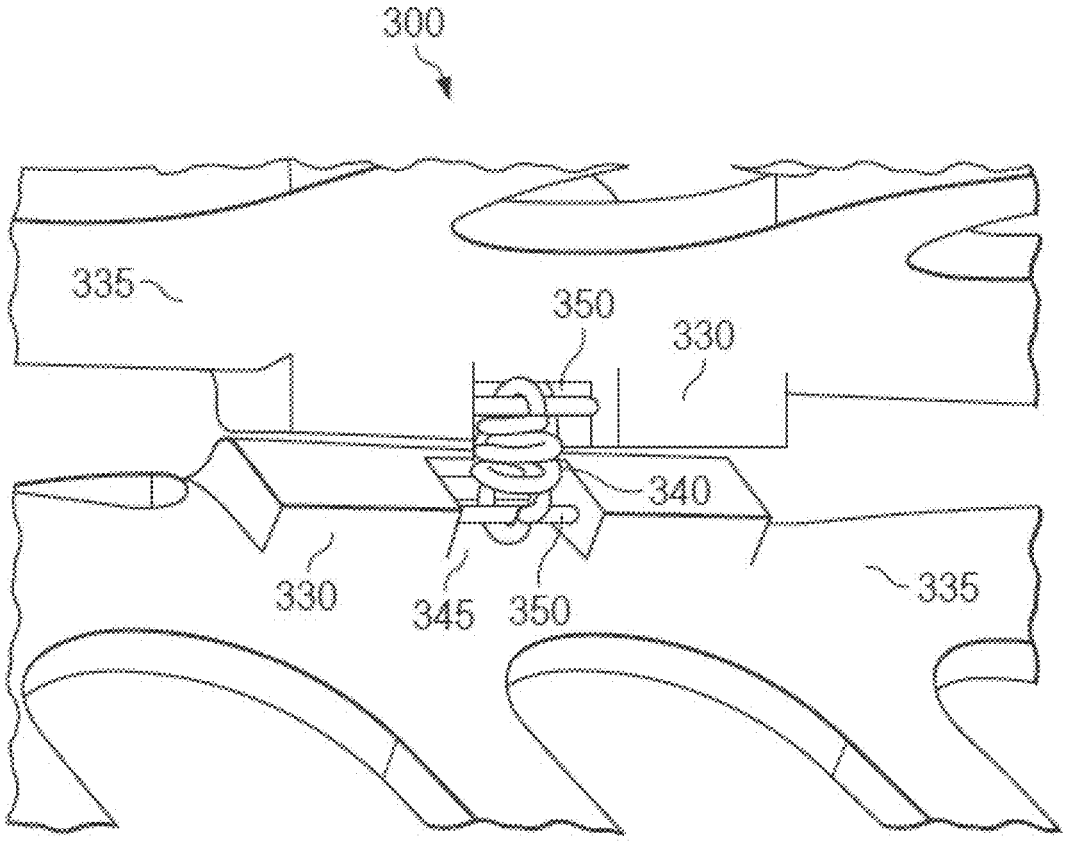
FIG. 3C is an enlarged perspective view of a portion of FIG. 3B showing the hinge mechanism thereof.
Figure 3D:
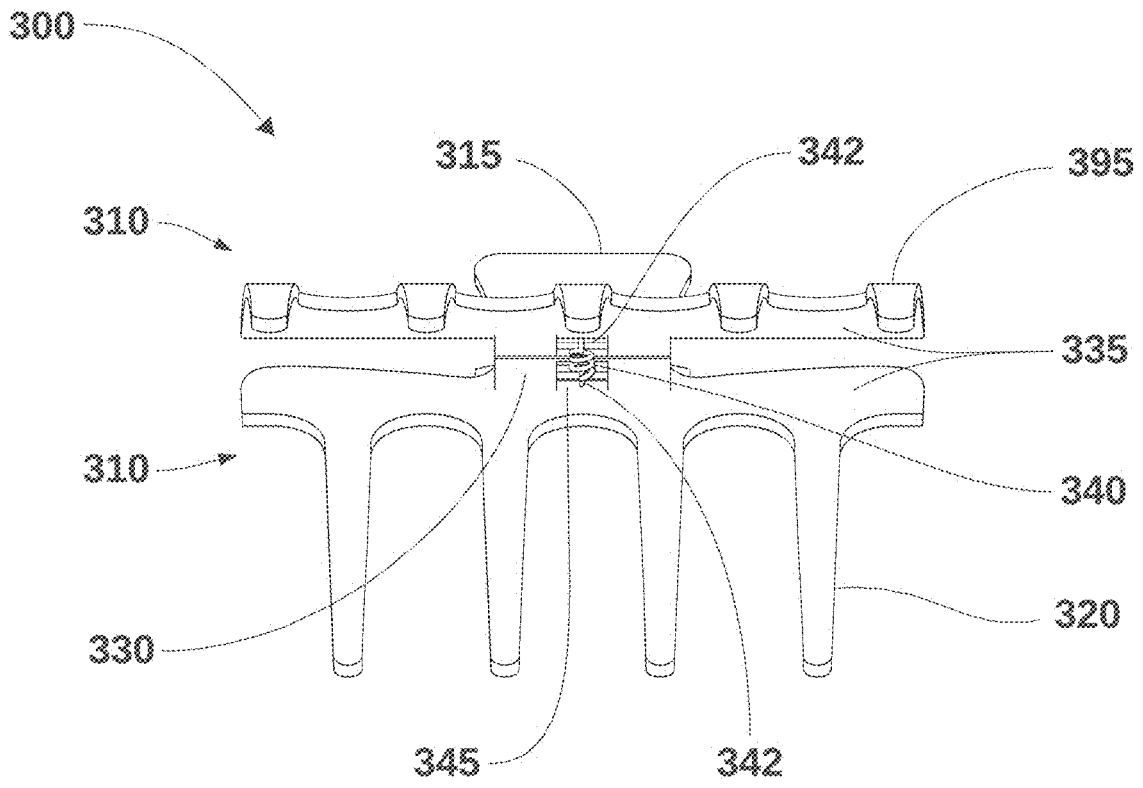
FIG. 3D is front elevational view thereof showing the hair clip in an open configuration.
Figure 3E:
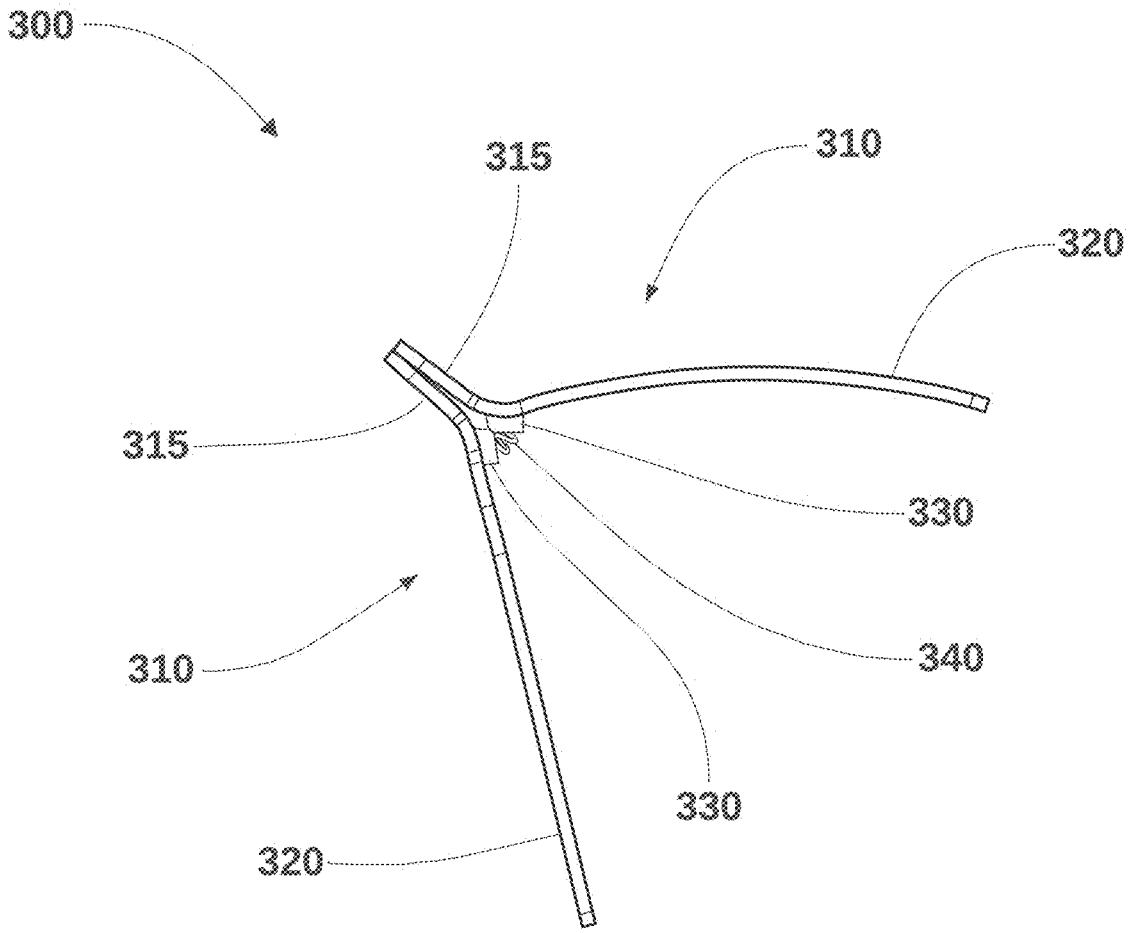
FIG. 3E is side elevational view thereof showing the hair clip in an open configuration.

FIGS. 3A-3E show a second embodiment of the disclosed invention in the form of a side hair claw clip. The hair clip is comprised of two adjacent clip members 310 each having a handle 315 and an array of teeth 320. As in the first embodiment of the invention discussed above in connection with FIGS. 1A-1D, only a singular engagement seam 325 is visible while in use in a closed configuration as best seen in FIG. 3A. Engagement shoulders 330 protruding inwardly from the base portions 335 of the teeth 320 of each clip member 310 are disposed in abutting engagement thereby providing a rolling pivot axis around which the clip members 310 pivot and form the engagement seam 325. An extension spring 340 is disposed in opposing recesses 345 provided in shoulders 330 as seen in FIGS. 3B-3D. In the embodiment shown in FIGS. 3B-3C each end of the extension spring 340 is fixed to one of the engagement shoulders 330 via anchor pins 350 such that the spring 340 joins the clip members 310 together while biasing them toward the closed configuration shown in FIG. 3A. As seen in FIG. 3D, each end 342 of the spring 340 is embedded directly into the base portion 335 of the teeth 320 of one of the clip members 310.

In the embodiments illustrated in FIGS. 3A-3E handles 315 act as levers that open the teeth 320 of the side hair claw clip members 310 while springs 320 urge the teeth 320 of the clip to the closed configuration such as for retaining hair. It is understood that pivot pins or spring hinge mechanisms are not required for this invention to function. Body members or coupled springs may comprise resilient or elastomeric materials used to bias body members and retain hair.

Figure 3F:
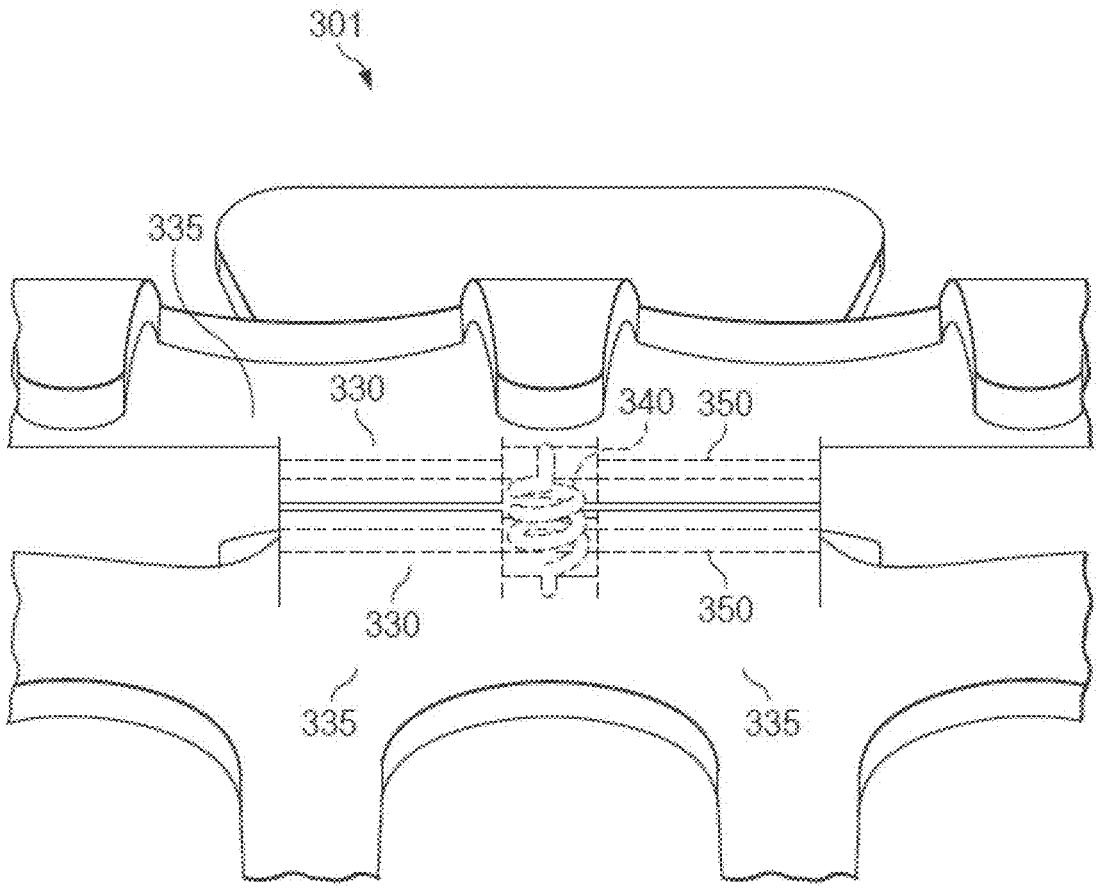
FIG. 3F is an enlarged view of a portion of another embodiment of the invention similar to that shown in FIGS. 3A-3E.

With reference now to FIG. 3F, in an enlarged view of a portion of another embodiment 301 of a hair clip according to the invention, similar to the embodiment shown in FIG. 3D, anchor pins 355 and spring 340 (both indicated in broken lines) are enclosed in engagement shoulders 330 so that they are hidden when the hair clip is viewed from an internal vantage point.

The invention disclosed herein is applicable to side hair claw clips of all hinge styles. FIGS. 4A-4D show additional examples of how the invention may be applied to four representative styles of side hair claw clips with four different types of hinges.

Figure 4A:
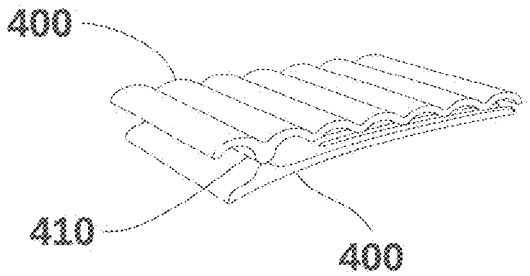
FIGS. 4A-4D show representative examples of how the second embodiment of the invention disclosed herein may be applied to four different side claw clip styles.

FIG. 4A is a perspective view of an extruded ornamental side hair claw clip having two clip members 400 which pivot about a single seamed hinge 410. A spring provided on the underside of the clip to ensure closure is not shown for clarity. It is understood that one or more body members may be made from resilient material to open and close the clip members to readily retain hair.

Figure 4B:
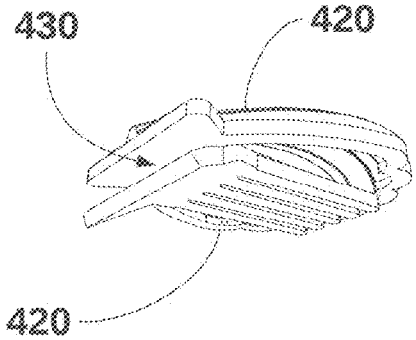

FIG. 4B is a perspective view of a seashell ornamental side hair claw clip having two clip members 420 which pivot about a single seamed hinge 430. The resilient material provided on the underside of the claw to ensure closure is not shown for clarity.

Figure 4C:
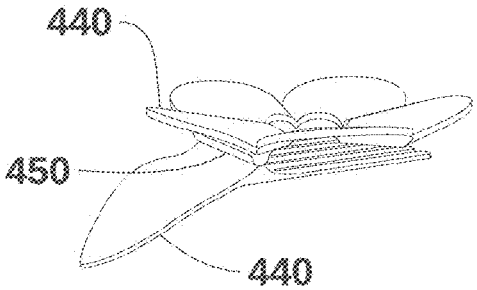

FIG. 4C is a perspective view of a flower and leaf ornamental side hair claw clip having two clip members 440 which pivot about a single seamed hinge 450. A resilient component on the underside of the clip that both connects and aligns the two clip members is not illustrated.

Figure 4D:
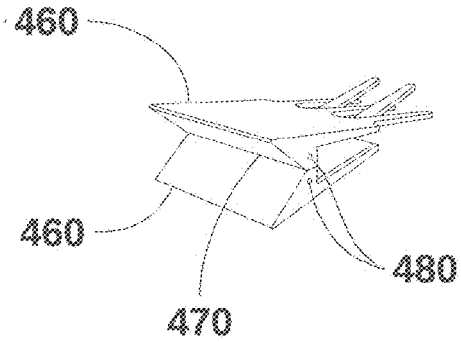

FIG. 4D is a perspective view of an ornamental side hair claw clip having two clip members 460 and a single seamed hinge 470, which rotates along the pins 480 in the claw clip. Springs provided on the underside of the claw to ensure closure are not shown for clarity. It is understood that one or more body members may be made from resilient materials to open and close the clip members to readily retain hair.

While two pin and virtual hinges are used in most of the examples shown above, one skilled in the art will understand that these are just for illustrative purposes and all types of hinges including, but not limited to, living hinges, single pin hinges, piano hinges, geared hinges, etc. may be employed as long as there is a single outermost seam. Similarly, resilient materials of all types, e.g., elastomeric materials, spring-metals, all manner of springs, e.g., torsion springs, coupled torsion springs, extension springs, leaf springs, clock springs, and components, such as split rings, may be used to bias the hair clip to a closed configuration.

While no hinge pins, knuckles, or connectors are required for the hinge to operate effectively, they are not precluded from use in this invention. Furthermore, independent of the type of resilient materials, components, and/or springs used to connect and orient the leaves, the seam between the two leaves does not have to be a single straight line but can be of any arbitrary shape depending on the aesthetics desired. Thus, it is understood that variations in the shape of the gap including, but not limited to, polygonal or curved shapes, e.g., portions of circles, parabolas, ellipses, catenaries, or organic shapes, fall within the ambit of this invention. Furthermore, the cross-section of the gap may be different on each leaf.

There have thus been described and illustrated certain embodiments of spring hair clips with a single outermost seam according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A hair clip having a hidden hinge, the hair clip comprising:

a first and a second clip member, both of the first and second clip members having a grabbable handle, an array of teeth extending away from the handle, and one or more inwardly extending engagement shoulders disposed between the handle and the array of teeth, at least one of said one or more engagement shoulders of said first clip member in abutting engagement with one of the one or more engagement shoulders of said second clip member along a continuous linear engagement seam, said engagement seam extending substantially parallel with the array of teeth of at least one of said first and second clip members, so that said first and second clip members pivot about said engagement seam between open and closed configurations, and one or more resilient members coupling together said first and second clip members, at least one of the one or more engagement shoulders of said first and second clip members disposed between the handles and said one or more resilient members of said clip members, so that all portions of the one or more resilient members are hidden when viewing the hair clip from an outer vantage point, such that the one or more resilient members bias said first and second clip members from the open configuration toward the closed configuration and retain at least one of the one or more engagement shoulders of said first member in continuous abutting engagement with at least one of the one or more engagement shoulders of said second clip member when pivoting said first and second clip members between the open and closed configurations.

2. The hair clip of claim 1, further comprising:

each of the one or more engagement shoulders of said first and second clip members having an inner edge disposed between the array of teeth and the engagement seam, and one of said one or more resilient members disposed adjacent the inner edges of the one or more engagement shoulders of said first and second clip members.

3. The hair clip of claim 1, wherein the one or more resilient members comprise one or more springs.

4. The hair clip of claim 1, wherein said engagement shoulders of one or both of said first and second clip members have an arcuate shape along the entire length of said engagement seam.

5. The hair clip of claim 4 wherein said engagement shoulders of one or both of said first and second clip members have said arcuate shape along the entire length of said engagement seam.

6. The hair clip of claim 1, wherein each of the one or more resilient members has a tensed state and a relatively relaxed state, each of said first and second clip members has a grabbable handle, in the closed configuration, the handles of said first and second clip members are spaced apart, the one or more resilient members are in the relatively relaxed state, and the arrays of teeth of said first and second clip members are in adjacent and overlapping position, and in the open configuration, the handles of said first and second clip members are generally in adjacent disposition, the one or more resilient members are in the tensed state, and the arrays of teeth of said first and second clip members are spaced apart.

7. The hair clip of claim 1, wherein said engagement seam is disposed between the handles of said first and second clip members.

8. The hair clip of claim 1, wherein each handle of said first and second clip members has an abutment face facing the abutment face of the other of said first and second clip members, each handle having an obverse face on the opposite side thereof, at least one end of at least one of said one or more resilient members including a coiled portion disposed on the obverse face of the handle between the engagement seam and the array of teeth, and in the open configuration said coiled portion is more tightly wound than when in the closed configuration.

9. The hair clip of claim 8, wherein said at least one end comprises at least two ends including first and second ends, each of said first and second ends having a coiled portion affixed to one of said first and second clip members, each of said coiled portions having an axial extent, and the coiled portions of said first and second ends spaced apart perpendicularly to the axial extents thereof, and at least one of said one or more resilient members includes a connector extending between and integrally coupling the coiled portions of said first and second ends, each of the coiled portions of said first and second ends disposed on opposite sides of said engagement seam, in the open configuration the coiled portion of each of said first and second ends more tightly wound than when in the closed configuration.

10. The hair clip of claim 9, further comprising:

the connector comprising resilient materials.

11. The hair clip of claim 9, further comprising:

the coiled portions of said first and second clip members defining a center opening having an axial dimension, said connector forming a loop extending perpendicularly to the axial dimension of said coiled portions to accommodate said engagement shoulders as said first and second clip members move between the open and closed configurations.

12. The hair clip of claim 8 further comprising:

at least one of said first and second clip members having one or more retaining structures, each of the one or more retaining structures having an axially extending bore, each of the coiled portions of the ends of the one or more resilient members defining a center opening, and one or more pivot pins, one of the one or more pivot pins received in the bore of at least one of the one or more retaining structures of one of said clip members and received in the center opening of the coiled portion of one end of at least one of the resilient members, such that said pivot pin defines a pivot axis about which one of said clip members pivots.

13. The hair clip of claim 12 wherein each of the one or more retaining structures forms a portion of one of the one or more engagement shoulders.

14. The hair clip of claim 12 further comprising:

at least one of the one or more retaining structures of both of said first and second clip members having an abutment face, and in the open configuration the abutment face of the at least one of the one or more retaining structures of one of said first and second clip members abutting the abutment face of the at least one of the one or more retaining structures of the other of said first and second clip members, thereby forming a portion of said engagement seam.

15. The hair clip of claim 12 further comprising:

each of the two clip members having one or more retaining structures, each of the coiled portions of the ends of the one or more resilient members defining a center opening, said one or more pivot pins comprising two or more pivot pins, and said two or more pivot pins in parallel disposition, each of the two or more pivot pins having an axial dimension, each one of the two pivot pins received in at least one of the one or more retaining structures of one of said first and second clip members and in the center opening of the coiled portion of one end of at least one of the resilient members, the pivot pin received in one of said at least one or more retaining structures of one of said first and second clip members spaced apart perpendicularly to the axial dimension of the pivot pin received in at least one of said one or more retaining structures of the other of said first and second clip members.

16. The hair clip of claim 15, wherein each pivot pin defines a pivot axis about which one of said first and second clip members pivots, the pivot axis of each of said first and second clip members spaced apart perpendicularly from the pivot axis of the other of said first and second clip members.

17. The hair clip of claim 8, further comprising:

said at least one end of at least one of the one or more resilient members comprising at least two ends including first and second ends said first and second ends each having a coiled portion, the coiled portions of said first and second ends connected by an uncoiled connector.

18. A hair clip having a hidden hinge, the hair clip comprising:

first and second clip members, each of said clip members having a grabbable handle, an array of teeth extending away from the handle, and one or more inwardly extending engagement shoulders, at least one of the one or more engagement shoulders of each of said first and second clip members in abutting engagement with one of the one or more engagement shoulders of the other of said first and second clip members along a continuous linear engagement seam extending substantially parallel with the array of teeth of at least one of said first and second clip members and about which said clip members pivot between open and closed configurations, and one or more resilient members coupling together said first and second clip members, each of the one or more resilient members having two ends, one or both of the two ends of at least one of the one or more resilient members including a coiled portion affixed to one of said first and second clip members, each of the coiled portions more tightly wound when said first and second clip members are in the open configuration than when in the closed configuration, at least one of the one or more engagement shoulders disposed between the handles of said first and second clip members and the one or more resilient members, so that all of the one of the one or more resilient members is hidden when viewing the hair clip from an outer vantage point when said first and second clip members are in the closed configuration or in the open configuration, such that the one or more resilient members bias said first and second clip members from the open configuration to the closed configuration and retain the engagement shoulders of said first and second clip members in continuous abutting engagement during pivoting motion of the handles between the open and closed configurations.

19. The hair clip of claim 18, wherein the one or more resilient members comprises at least one spring.

* * * * *